US006060652A

United States Patent [19]

Lombardi

[11] Patent Number: 6,060,652

[45] Date of Patent: May 9, 2000

[54] TUNABLE DRUM SUPPORT

[75] Inventor: Donald G. Lombardi, Thousand Oaks, Calif.

[73] Assignee: Drum Workshop, Inc., Oxnard, Calif.

[21] Appl. No.: 09/178,752

[22] Filed: Oct. 26, 1998

[51] Int. Cl.[7] ..... G10D 13/02

[52] U.S. Cl. ..... 84/421

[58] Field of Search ..... 84/327, 421, 453

[56] References Cited

U.S. PATENT DOCUMENTS 1,750,803 3/1930 Hayden ..... 84/421 X 5,335,575 8/1994 Hoshino ..... 84/421

5,467,680 11/1995 Kurosaki ..... 84/421

5,645,253 7/1997 Hoshino ..... 84/421 X

*Primary Examiner*—Stanley J. Witkowski

*Attorney, Agent, or Firm*—William W. Haefliger

[57] ABSTRACT

A drum support, comprising in combination at least one leg operatively connected to the drum, and extending below the drum, first and second feet associated with one leg engagable with a support surface, at least one of the feet positioned for adjustable movement relative to the other foot.

13 Claims, 3 Drawing Sheets

10
13
14
15
12
10a
12
11
24
22a
22
11a
20
22b
19
17
16
17a
18

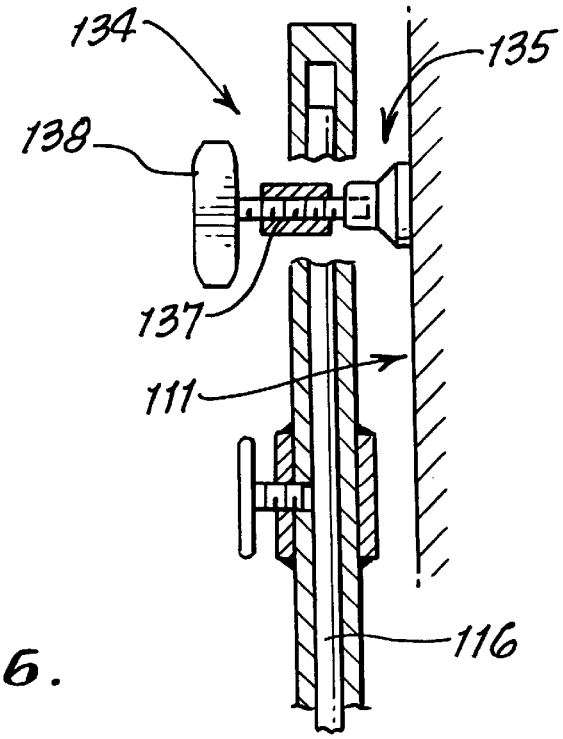
FIG. 6.
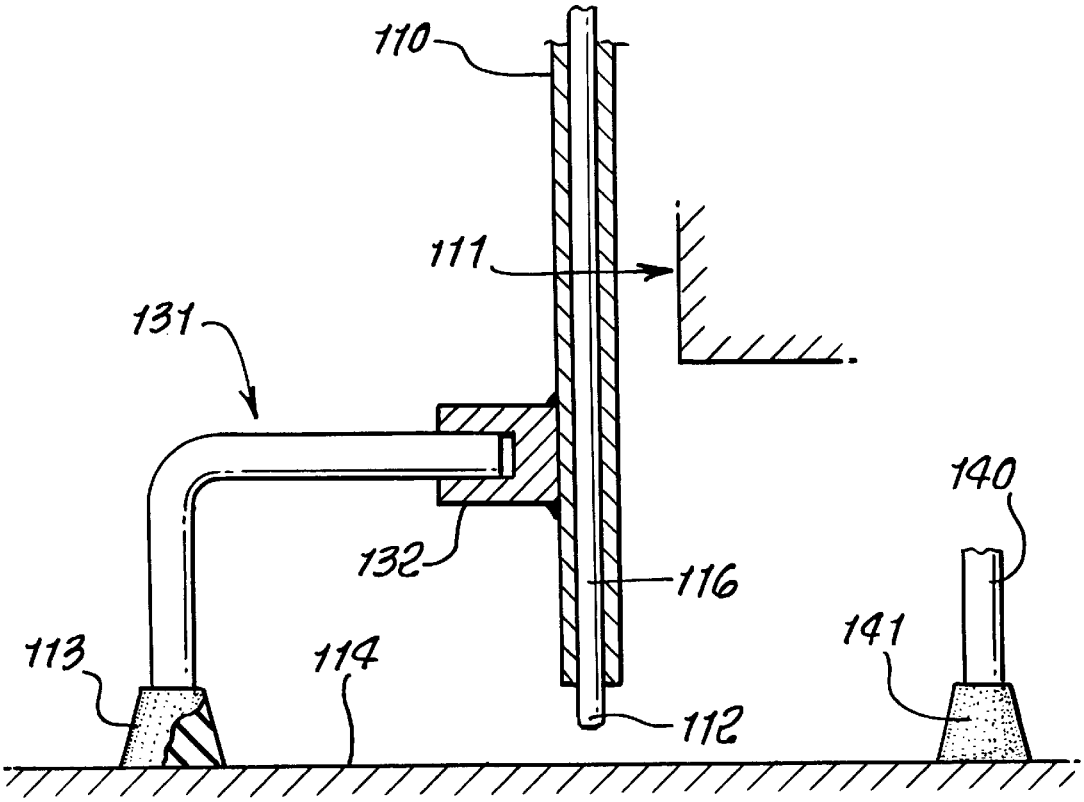

TUNABLE DRUM SUPPORT

BACKGROUND OF THE INVENTION

This invention relates generally to stands for percussion instruments; more particularly it concerns drum stands that affect the drum sound, tone and resonance.

It is known that a drum stand can affect the sound produced by the drum supported on that stand. In this regard, a drum is usually supported on rods each of which has its lower end portion supported directly or indirectly on the floor or support surface. It is desirable that a means be provided whereby drum sound, tone or resonance can be selectively altered, as via the stand or support rods.

SUMMARY OF THE INVENTION

It is a major object to provide an improved drum support meeting the above need. Basically, the improved drum support comprises:

a) at least one leg operatively connected to the drum, and extending below the drum, b) first and second feet associated with that one leg and engagable with a support surface, c) at least one of the feet positioned for adjustable movement relative to the other foot.

It is another object of the invention to provide for adjustable up and down movement of the one foot relative to the other foot.

A further object is to provide a member carrying the one foot and projecting upwardly from the one foot, the member and leg having adjustable connection, whereby the one foot and said member may be adjustably relatively positioned. That adjustable connection typically may include a holder for holding the leg and member in relatively adjusted position, vertically. The adjustable connection may include interengagable screw threads, whereby the elongated member, may comprise a rod. The other foot is typically joined to that rod, so that the two feet are laterally spaced apart.

An additional object is to provide a laterally and downwardly extending support part connecting the other foot to the leg or rod.

A yet further object includes providing a cushion associated with the other foot, offset from the one foot, so that sound transmission to and through the foot may be varied by adjusting the one foot relative to the cushion.

As will be seen, a drum supported by the leg and associated relatively adjustable two feet may also be supported by two additional supports one or both having a single foot, or two feet as described, for enhanced adjustment of drum sound.

These and other objects and advantages of the invention, as well as the details of an illustrative embodiment, will be more fully understood from the following specification and drawings, in which:

DRAWING DESCRIPTION

FIG. 6 is an elevation showing a modification.

DETAILED DESCRIPTION

Figure 1:
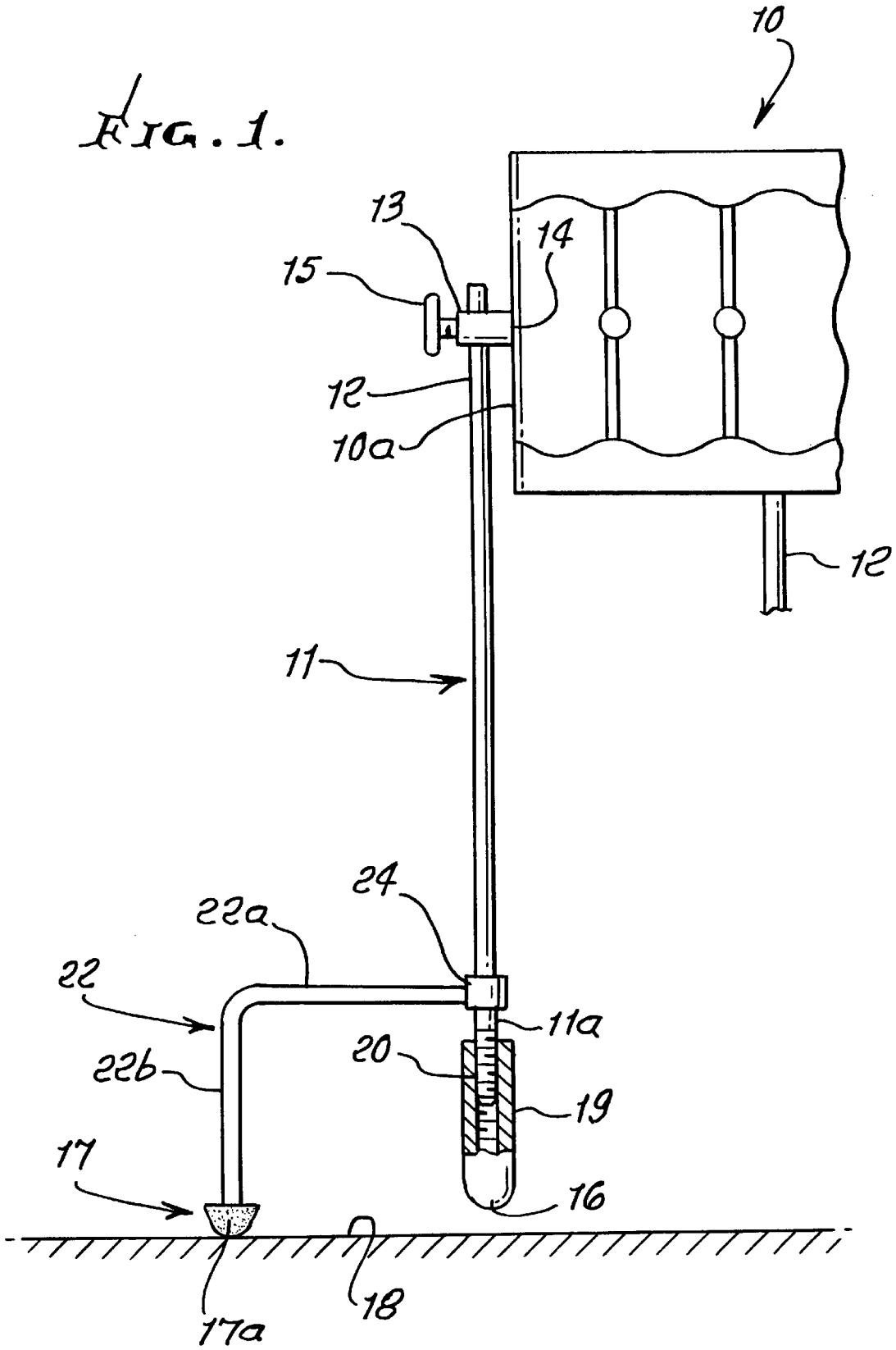
FIG. 1 is an elevation view showing a drum having an adjustable support incorporating the invention.

In the preferred example of FIG. 1, a drum 10 is supported via a first leg 11, operatively connected to the drum as at shell 10*a*. That leg may take the form of a metallic rod extending vertically, as shown. The other legs are provided, as represented by leg or legs 12 (see FIGS. 2–4). Leg rod 11 may be vertically slidable in a sleeve 13 connected to the shell at 14. A set screw 15 in sleeve is tightened to engage rod 11 at the drum height adjusted position.

First and second feet are associated with leg 11, and are indicated at 16 and 17. Such feet are engagable with a support surface 18. At least one of the feet is positioned for adjustable movement relative to the other foot. The one foot may be either of the feet 16 and 17, but is shown in the example as foot 16, adjustably movable up and down relative to foot 17, as for example vertically. Foot 16 may be provided on a carrier telescopically engagable with the lower end portion 11*a* of the rod, and the carrier may include a sleeve member 19 into which end rod portion 11*a* is received. A screw thread connection is provided at 20, enabling sleeve rotation to move foot 16 up and down. The thread 20 is one form of holder acting to hold the leg 11 and member 19 in selectively adjusted position vertically.

As shown, the first and second feet 16 and 17 are laterally offset relative to one another. This is facilitated by provision of a part 22 connecting foot 17 to the leg rod as at 24, part 22 having laterally and downwardly extending portions 22*a* and 22*b*. These portions may form an L or a curved configuration, for example. Foot 17 may include a cushion as may be provided by a rubber grommet 17*a*, acting to absorb acoustic waves traveling between rod 11 and surface 18, when the foot 17 engages that surface.

Figure 2:
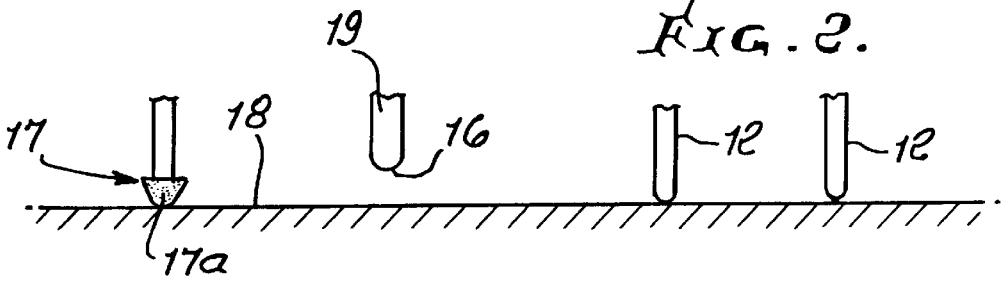
FIGS. 2, 3 and 4 are fragmentary elevations showing various modes of support adjustment and configurations.

FIG. 2 shows foot 16 adjusted by elevation to disengage surface 18, whereby acoustic waves traveling lengthwise of rod 11, as during drumming are attenuated by cushion 17*a* before transmission by foot 17 to the floor or surface 18. This provides a somewhat attenuated drum sound, during drumming. Rods 12 engage the floor and transmit drum generated acoustic waves to the floor.

Figure 3:
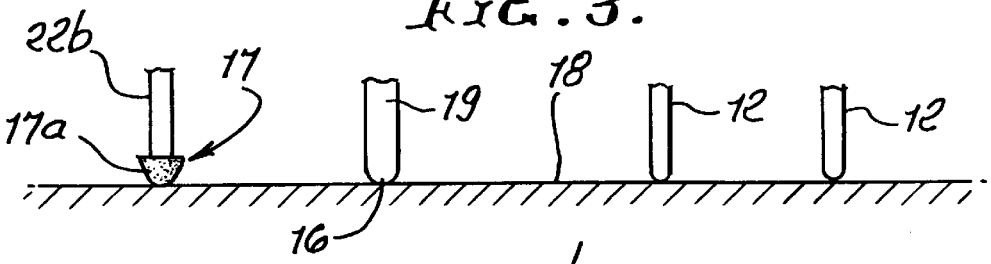

In FIG. 3, both feet 16 and 17 engage the floor surface 18, and support the drum. Accordingly, some unattenuated acoustic waves in rod 11 reach the floor via foot 16, whereas other acoustic waves in rod 11 pass via 22 to the foot 17 via the cushion 17*a*, acting to attenuate such waves. The degree of contact of 17 with the floor is adjustable by rotation of carrier 19, to move it up or down. The more drum weight is transmitted to cushion 17*a*, the more that cushion is compressed, affecting drum sound. Accordingly, the drum sound can be tuned by that adjustment. Again, rods 12 engage the surface 18.

Figure 4:
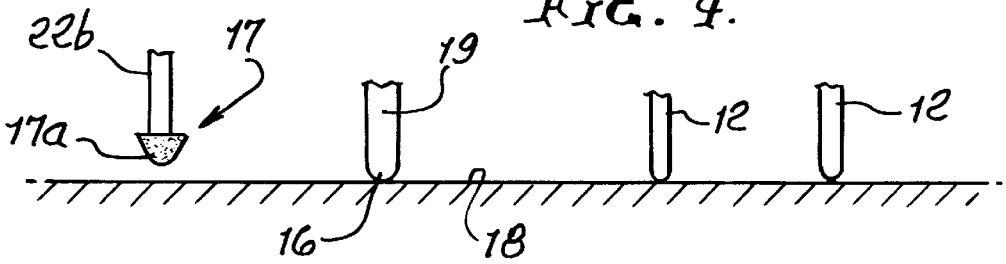

In FIG. 4, carrier 19 has been rotated to move it relatively downwardly, whereby only foot 16 supports rod 11, and foot 17 is relatively elevated. The acoustic waves in rod 11 then are unattenuated before transmission to the floor. Such waves may be reflected back upwardly in metallic elements 16, 19 and 11. The drum sound is now sharper. Again rods 12 engage the surface.

Figure 5:
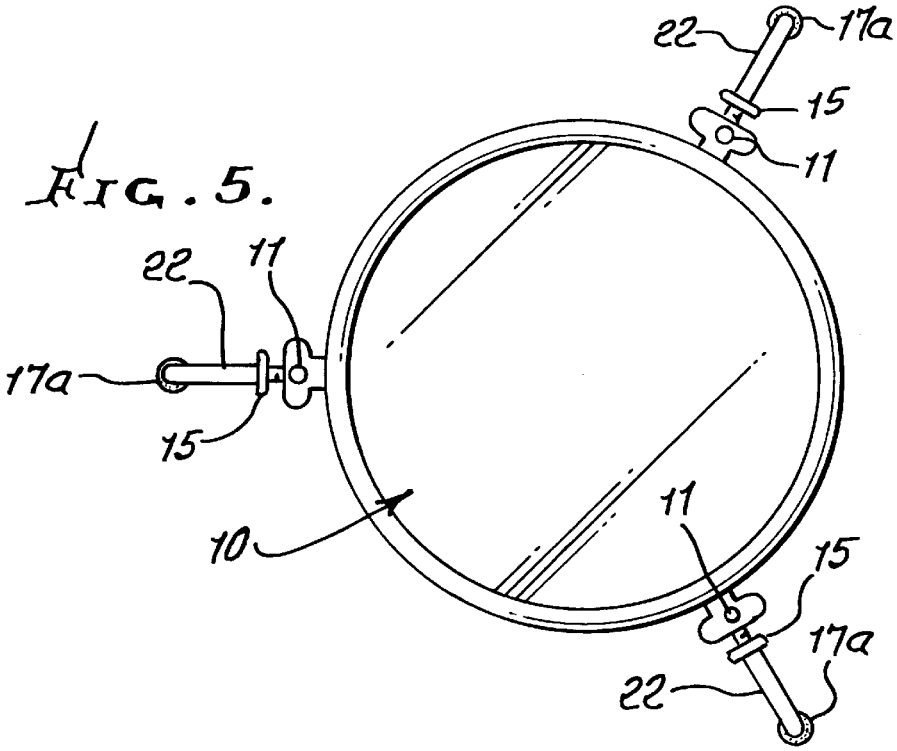
FIG. 5 is a plan view of a drum with adjustable supports at all three legs.

In FIG. 5, the arrangement is the same excepting that rods 12 now additionally have elements 16, 17*a*, 19, 22 and 24 associated therewith. It then becomes possible to enhance the tuning effect, since all three cushions or two cushions, or one cushion, or no cushion, may be positioned to effect acoustic wave transmission in the rods 11 and 12, in the manner explained above. Cushions 17*a* may be springs, rubber, or other resiliently yieldable devices.

It is possible to eliminate all cushions, whereby offset foot or feet 17 are completely metallically coupled to rod or rods 11 and 12; and in this regard, different drum sounds will be produced depending upon which of the feet 16 and 17 support the drum, at each rod 11 and 12 location, for drum sound tuning.

I claim:

1. A drum support, comprising, in combination with the drum spaced above a floor:

a) at least three legs to support the drum, at least one of the legs operatively connected to the drum, and extending near the drum, b) first and second floor engaging feet associated with and carried by only said one leg to be selectively engageable with the floor, said feet being spaced apart, c) at least one of said feet positioned for adjustable up and down movement relative to the other foot, whereby either the first or the second of the feet, or both, as selected, provides drum support via said one leg to transmit a portion of drum weight to the floor, thereby to achieve a selected drumming sound, during drumming.

2. The combination of claim 1 including a member carrying said one foot and projecting upwardly from said one foot, said member and said leg having adjustable connection whereby said one foot and said member may be adjustably relatively positioned, generally vertically.

3. The combination of claim 2 wherein said adjustable connection includes a holder for holding said leg and member in relatively adjusted position, vertically.

4. The combination of claim 2 wherein said adjustable connection includes interengageable screw threads.

5. The combination of claim 3 wherein said leg comprises an elongated shaft.

6. The combination of claim 1 wherein said first and second feet are laterally offset relative to one another.

7. The combination of claim 6 including a laterally and downwardly extending part connecting the other foot to the leg.

8. The combination of claim 7 wherein said part joins said leg at a location above said one foot.

9. The combination of claim 1 including a cushion associated with said other foot.

10. The combination of claim 1 wherein said legs, other than said one leg, are located in spaced relation to said one leg.

11. The combination of claim 10 wherein at least one of the additional supports includes elements a), b) and c) of claim 1.

12. The combination of claim 1 wherein there are only three of said legs.

13. The method of altering drum sound, that includes the steps:

a) providing three legs to support the drum, at least one of the legs operatively connected to the drum, and extending near the drum, b) providing first and second floor engaging feet associated with and carried by only said one leg to be selectively engageable with the floor, said feet being spaced apart, c) at least one of said feet positioned for adjustable up and down movement relative to the other foot, and d) adjusting the position of said one of the feet, up or down, to engage or disengage the floor, so as to achieve a selected drumming sound, during drumming.

* * * * *